United States Patent [19]

Sebest

[11] Patent Number: 4,535,492

[45] Date of Patent: Aug. 20, 1985

[54] PILLOW BED MECHANISM

[75] Inventor: Albert E. Sebest, Lancaster, Pa.

[73] Assignee: Spectro Industries, Inc., Jenkintown, Pa.

[21] Appl. No.: 450,264

[22] Filed: Dec. 16, 1982

[51] Int. Cl.[3] ..... A61G 7/00

[52] U.S. Cl. ..... 5/68; 5/72

[58] Field of Search ..... 5/66–69, 5/72, 73, 74–79, 80, 433

[56] References Cited

U.S. PATENT DOCUMENTS

| | | | |
|---|---|---|---|
| 55,496 | 6/1966 | Hutchinson | 5/66 |
| 1,312,614 | 3/1915 | Payne | 5/66 |
| 1,701,588 | 8/1926 | Muller | 5/24 |
| 1,731,251 | 6/1927 | McIntosh | 5/63 |
| 2,297,105 | 8/1940 | Laukhuff | 5/69 |
| 2,379,080 | 4/1943 | Hillenbrand | 5/69 |
| 2,407,892 | 5/1943 | Mehr | 5/66 |
| 2,500,744 | 3/1950 | Beem | 5/90 |
| 2,887,691 | 5/1959 | Talarico et al. | 5/62 |
| 3,036,314 | 5/1962 | Wetzler | 5/68 |
| 3,051,965 | 9/1962 | Szemplak et al. | 5/68 |
| 3,112,500 | 12/1963 | MacDonald | 5/69 |
| 3,149,348 | 9/1964 | Hillenbrand et al. | 5/63 |
| 3,191,196 | 6/1965 | Holm | 5/68 |
| 3,216,026 | 11/1965 | Mann | 5/66 |
| 3,222,693 | 12/1965 | Pruim et al. | 5/68 |
| 3,243,825 | 4/1966 | Tabbert | 5/62 |
| 3,267,493 | 8/1966 | Pruim et al. | 5/63 |
| 3,300,792 | 1/1967 | Spitz | 5/13 |
| 3,300,794 | 1/1967 | Altorfer | 5/68 |
| 3,465,373 | 9/1969 | Wilson | 5/63 |
| 3,503,082 | 3/1970 | Kerwit | 5/67 |
| 3,562,824 | 2/1971 | White | 5/61 |
| 3,646,621 | 3/1982 | Fragas | 5/66 |
| 3,686,696 | 8/1972 | Lanigan | 5/66 |
| 3,688,319 | 9/1972 | Gulliver | 5/66 |
| 3,898,702 | 8/1975 | Goodman | 5/68 |
| 4,247,091 | 1/1981 | Glowacki et al. | 5/66 |
| 4,349,924 | 9/1982 | Zur | 5/68 |

*Primary Examiner*—Alexander Grosz

[57] ABSTRACT

A mechanism for providing varying degrees of elevation to separately movable head-rest and back-support sections. Head-rest and back-support sections are pivotable about points on a frame section and are pivotally connected to one another to allow controlled reclining movements. A drive motor powers a positioning device to allow the back-support section to vary from upright to horizontal. When the positioning device engages a deflector at the head of the bed, the head-rest section tilts upward to form a pillow even though the back-support section remains horizontal.

4 Claims, 4 Drawing Figures

PILLOW BED MECHANISM

BACKGROUND OF THE PRIOR ART

The current invention relates to adjustable body supporting mechanisms that allow a resting person to maintain his upper torso in an elevated position. More particularly, the present invention allows either the head rest section to independently elevate the head of a resting person, or the back-support and head-rest sections to maintain the upper torso and head of the person in various angularly inclined positions. In addition, control of the positioning device within the invention can be accomplished by the individual alone, so that an attendant is not required.

It is known to put joints in the hip-area and knee-area in hospital beds, and thus give the patient a back rest and a place to bend his legs over. Such a disclosure is made in U.S. Pat. No. 3,191,196 to L. E. Holm. That invention allows either controlled, coordinated elevation of the back-rest and knee-rest, or elevation of only one.

It is also known to give independent support to the resting individual's head. U.S. Pat. No. 3,051,965 to J. C. Szemplak et al discloses an invention that has a separately adjustable headrest with individual adjusting screws for adjusting the headrest. This bed would also raise the back and provide a knee rest.

U.S. Pat. No. 4,349,924 to H. C. Zur is also of significance. The invention disclosed by that patent teaches that a single power means can be used to raise and lower an adjustable body supporting assembly, including a back-support section and a head-rest section. The head-rest section is pivotally linked to the back support section so as to always move proportionately with it.

SUMMARY OF THE INVENTION

A pillow bed mechanism is disclosed that can be controlled to give individual movement, either inclining or reclining, to a head-rest section or to the combination back-support and head-rest sections. This arrangement is made possible by pivotably interconnecting a back-support member and a head-rest member at a predetermined point, by pivotally connecting these levers to a framework, and further, by changing the direction of force exerted on those sections.

A positioning device, consisting of a drive bar that is connected at a predetermined angle to a curved brace that carries a roller and axle at its top end, slides along the back side of the back-support member until both the head-rest and back-support members are horizontal. This moving pivot point is then deflected from the back side by a curved deflector, and the resulting change in the direction of force causes the top end of the head-rest section to tilt upward, thereby forming a controllable head-rest section.

OBJECTS OF THE INVENTION

An object of the invention is to provide a mechanism which allows comfortable resting thereon by individuals.

Another object of the invention is to provide an improved mechanism which allows comfortable resting thereon and which can be controlled by the individual.

A further object of the invention is to provide an improved mechanism for comfortable resting that has individually controllable head-rest and back-support sections.

A still further object of the invention is to provide an improved mechanism which has individually controllable head-rest and back-support sections that will allow an individual to lie flat with only his head raised.

These and other objects of this invention will appear from the following specification, and are not be construed as limiting the scope of the invention thereto, since in view of the disclosure herein, others may be able to make additional embodiments within the scope of the appended claims.

DESCRIPTION OF THE PREFERRED EMBODIMENT

The principles disclosed in the Zur patent (as noted above) illustrate how pivoting linkage can be interconnected to allow a single drive mechanism to work a plurality of sections. The assembly in that U.S. patent allowed the angular adjustment of a lower back section and an upper head-rest secgtion by the pivoting relationship of these sections off of a horizontal framework. The invention of the present application improves upon that concept.

Figure 1:
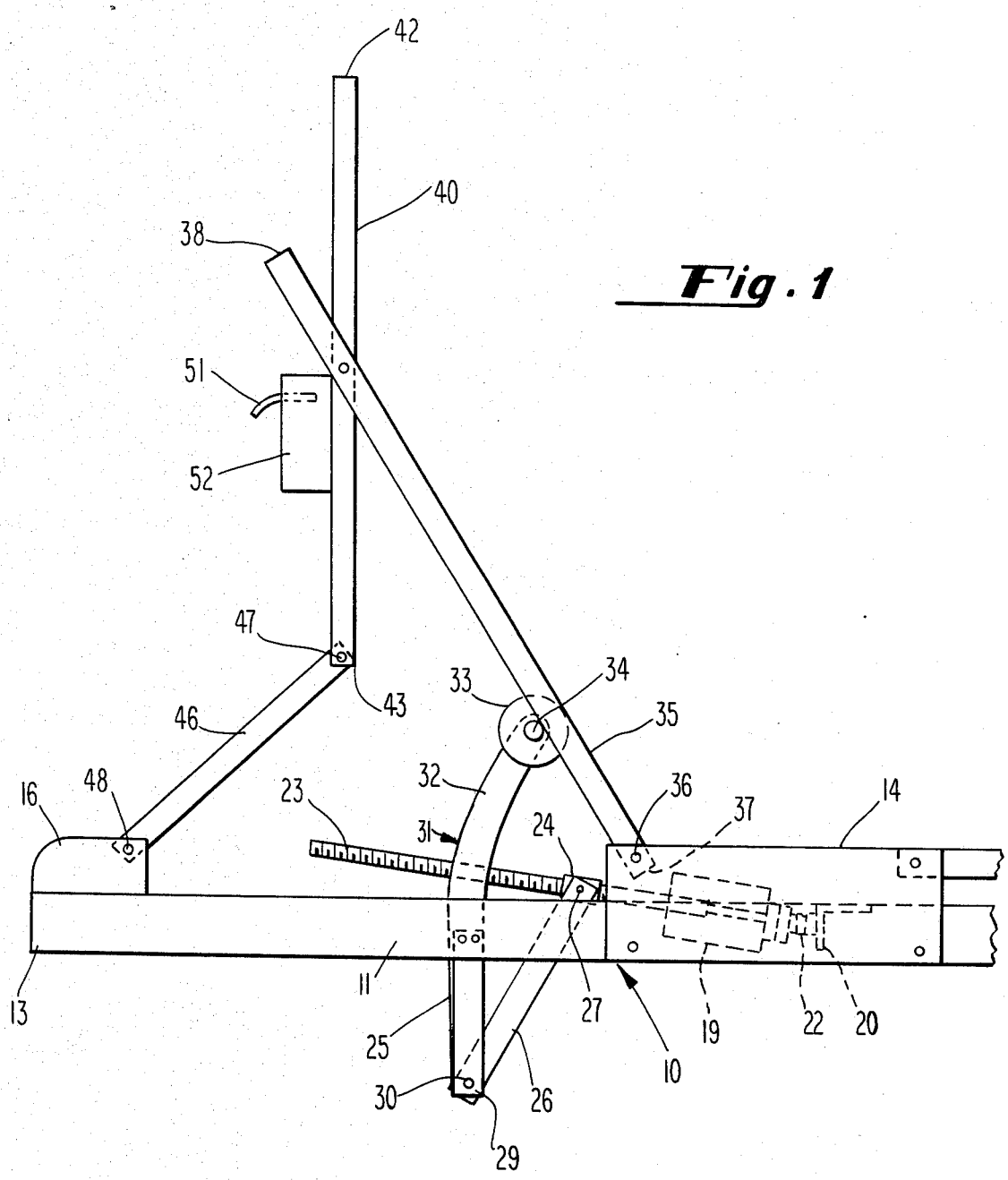
FIG. 1—a view in elevation of the improved apparatus in its fully upright position.

Referring now to the drawings in detail, reference is made to FIG. 1 wherein the pillow bed mechanism is illustrated in its substantially upright or vertical position. The total parts of the pillow bed mechanism are built upon a frame section 10 that is then anchored to the framework for a particular bed. Frame 10 has side pieces 11 (only one shown) and end pieces (not shown) to form a rectangular shape. Frame section 10 is oriented upon a particular bed so that pillow end 13 is oriented up toward the head of the bed and a side plate 14 is located a predetermined distance toward the foot of the bed. Pillow end 13 has restraint bar anchor tab 16 securely fixed thereto so as to extend vertically upward toward a mattress resting upon the mechanism.

Located adjacent to side plate 14 and to the inside of frame section 10 is a drive means 19 (shown in ghost) such as an electric motor or a comparable type of driving device that is known in the art. A securing shelf 20 is attached to frame section 10 on the inside near side plate 14 and a shelf hinge 22 joins drive means 19 to shelf 20 to allow limited rotational movement thereabout. Drive means 19 powers a worm gear 23. Worm gear 23 is of a predetermined length with threads of appropriate degree and allows a rider ring 24 to be powered in threaded engagement from the rearward end of gear 23 out to the pillow end.

One of the novel features of the current invention is a positioning device 25. Positioning device 25 includes a drive bar 26 of a predetermined length pivotally connected to rider ring 24 at a first pivot point 27. Device 25 also includes a movable support means 31 which supports the weight of a back-support section 35. Support means 31 is comprised of a curved brace 32 which is joined to drive bar 26 in a predetermined angle at a second pivot point 30. Second pivot point 30 is maintained at a predetermined, fixed position beneath frame section 10 by anchor tab 29. Curved brace 32 has at least one roller 33 on a roller axle 34 at the uppermost end thereof. If necessary, more rollers may be added. Anchor tab 29 is of a predetermined length and the curve in curved brace 32 is precalculated to allow the rider ring to be at the innermost position and cause drive bar 26, which is firmly connected at a predetermined angle to curved brace 32, to cause the curved brace to exert a force against, and support back-support, section 35 in a substantially, or raised vertical position. The movement of rider ring 24 along worm gear 23 and the operation of roller 33 will be discussed below.

Another of the novel features of the pillow bed mechanism is the interconnection of back-support section 35 and a head-rest section 40. Back-support section 35 is pivotably connected to side plate 14 at a third pivot point 36. Back-support section 35 has a proximate end 37 and a distal end 38. The proximate end 37 is pivotably connected to the upper corner of side plate 14. Head-rest section 40 has a distal end 42 and a proximate end 43. The pivotal connection between back-support section 35 and head-rest section 40 is at a fourth pivot point 41 which is located midway between distal end 42 and proximate end 43 and adjacent distal end 38 of section 35. Proximate end 43 of section 40 is pivotably connected at a fifth pivot point 47 to a restraint bar 46. Restraint bar 46 is pivotably connected at a sixth pivot point 48 to restraint bar anchor tab 16.

A further novel feature of the pillow bed mechanism is the addition of a concave deflector 51 extending from a deflector casing 52 which is fixedly connected to the backside of head-rest section 40. The positioning of deflector casing 52, and therefore deflector 50, is such that it causes deflector 51 to be aligned with the path that roller 33 makes along the backside of section 35. Therefore, as roller 33 proceeds along the backside of section 35 and nears fourth pivot point 41, it is directed off of the underside by deflector 51 and rolls around inside the curve of deflector 51, thereby changing the direction of the force that it exerts against the mechanism and causing the distal end 42 of head-rest section 40 to tilt forward in a clockwise movement.

Figure 2:
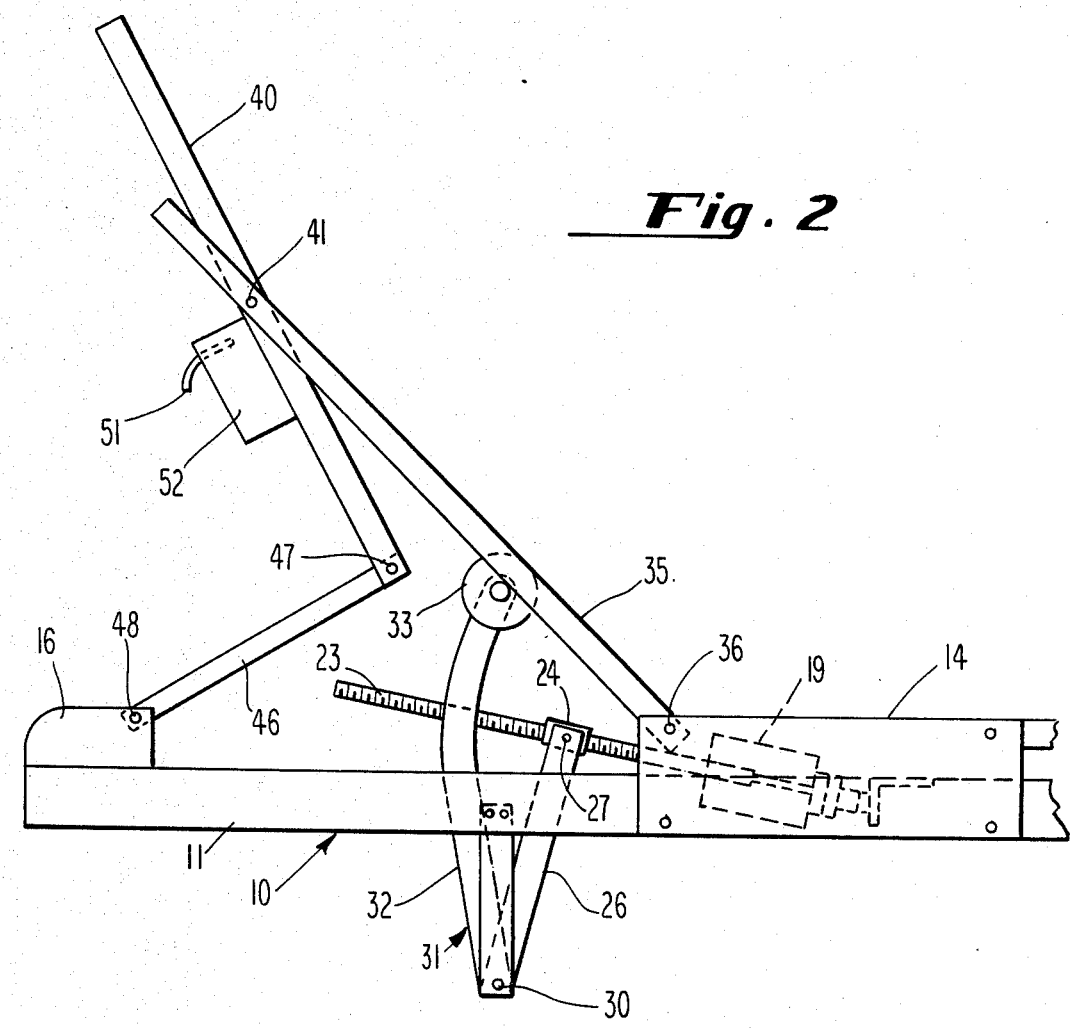
FIG. 2—a view in elevation of the apparatus in the partially extended position.
Figure 3:
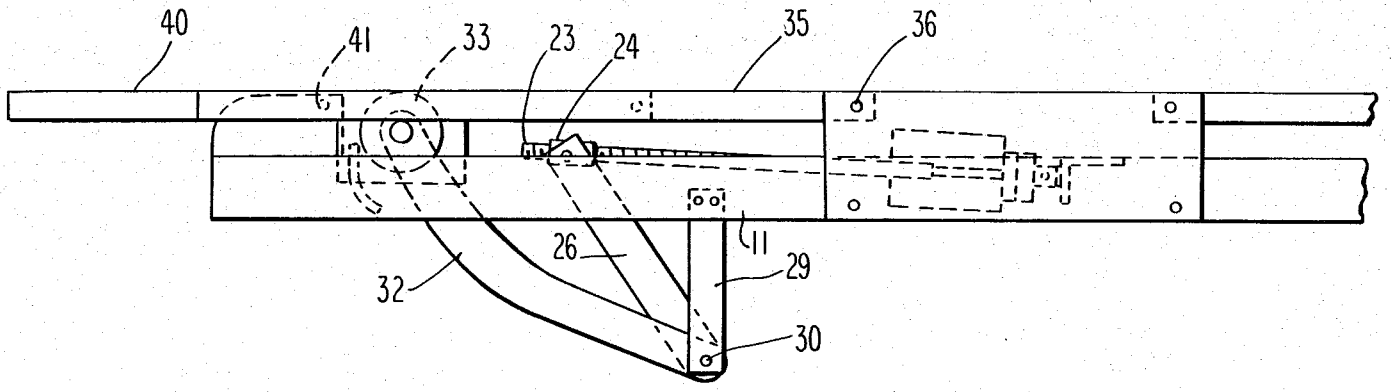
FIG. 3—a view in elevation of the apparatus in the horizontal position.
Figure 4:
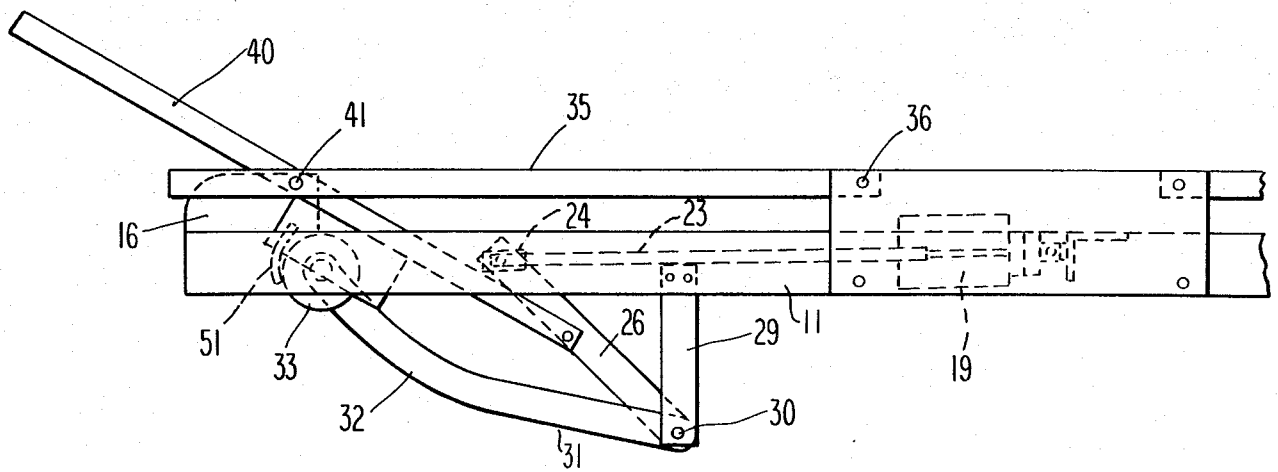
FIG. 4—a view in elevation of the apparatus in the pillow-only position.

The operation of the pillow bed mechanism can be seen more clearly by referring to FIGS. 2, 3 and 4. As shown in FIG. 2, the rider ring 24 has advanced a short distance toward the pillow end of worm gear 23 and support 31, through roller 33, therefore provides the necessary force to support section 35 in a raised, or inclined, position. This is caused by drive means 19 (shown in ghost) causing worm gear 23 to revolve. As rider ring 24 proceeds in threaded engagement along gear 23, drive bar 26 and curved brace 32 are also subsequently moved. As curved brace 32 moves toward the pillow end, roller 33 moves along the underside of back-support section 35. As roller 33 moves toward the pillow end of the mechanism, the distance between roller 33 and third pivot point 36 increases, thus allowing back-support section and head-rest section 40 to tend toward a common horizontal plane.

FIG. 3 illustrates the configuration as rider ring 24 nears the pillow end of gear 23. As can be seen from the ghost outline, roller 33 is approximately at fourth pivot point 41 and back-support section 35 and head-rest section 40 are now in a common plane in a fully extended horizontal position. As can also be seen from the ghost lines, drive means 19 has lowered slightly from its upwardly tilted position. Drive bar 26 has been pushed out to the forward extreme and is rotating about rider ring 24 at first pivot point 27. As drive bar 26 is in this position, the angular relationship between bar 26 and curved brace 32 causes the roller 33 to come to rest in a plane such that back-support section 35 is in the horizontal plane. Bar 26 and brace 32 have been in fixed rotation about the axis at second pivot point 30 which is at a predetermined position at the end of anchor tab 29.

As shown in FIG. 4, roller 33 has departed from the underside of back-support section 35 and engaged the reflector 51. This allows the novel feature of a heads-up pillow mechanism to be activated without any movement out of the horizontal plane by back-support section 35. As can be seen in the ghost figures, rider ring 24 is at the extreme limit of gear 23. Drive bar 26 is at its forwardmost position, thus causing curved brace 32 and roller 33 to engage the curved deflector 51. Deflector 51 is in the form of a curved fence and the curve at the outermost end of the deflector 51 is precalculated to cause the distal end 42 of heat-rest section 40 to rotate upward into an approximately 45° raised position.

It has been found from operational models that only a single positioning device 25 is necessary to raise and lower a twin-sized bed. However, it is envisioned that a dual-positioning device would be utilized, if necessary, for a full-size, or larger, bed. The distance from fourth pivot point 41 to third pivot point 36 is calculated to allow for the approximate sizes of the average person from the shoulders down to the hips. Correspondingly, the distance between fourth pivot point 41 and the distil end 42 of lever 40 has been precalculated to provide for a sufficient pillow area on a bed. Accordingly, various modifications may be made in the details of construction, as well as in the use and operation, all within the spirits of the invention as defined in the appended claims.

What I claim is:

1. An improved body supporting assembly wherein a horizontal frame member has a back-support section pivotally connected to head-rest section with a drive means for providing a force for raising and lowering said back-support section and said head-rest section from horizontal positions to angularly inclined positions relative to said frame, the improvement comprising linking said head-rest section to said back-support section at a predetermined point and deflecting said drive means to allow independent inclined movement of said head-rest section relative to the horizontal position of said back-support section.

2. An improved body supporting mechanism as in claim 1 wherein a concave deflector extends initially transversely from the underside of said head-rest section and translates a back-supporting force into a head-rest section tilting force.

3. An improved body supporting assembly wherein a horizontal frame member has a back-support section pivotally connected to a head-rest section with a drive means for providing a force for raising and lowering said back-support section and said head-rest section from horizontal positions to angularly inclined positions relative to said frame, the improvement comprising attaching a concave deflector initially transversely to the underside of said head-rest section to translate a back-supporting force into a head-rest section tilting force.

4. A body supporting assembly comprising:

a horizontally disposed frame section having a pillow section with a transversely projecting tab extending upwards, and an oppositely disposed foot-end section having (a) a side plate attached to the outer side thereof, (b) a downwardly projecting anchor tab of a predetermined length extending from the bottom thereof, and (c) a securing shelf extending inwardly therefrom;

a back-support section pivotally attached by the proximate end to said side plate;

a drive motor hingedly connected to said securing shelf for driving a worm gear, said gear extending towards the pillow section and threadedly moving a rider ring thereon;

a restraint bar with a first upper end and a second lower end and pivotably connected at said second end to said tab;

a head-rest section pivotably connected at the midpoint thereof to the distil end of said back-support section and pivotably connected at the bottom end to said restraint bar second end, and having a concave deflector extending initially transversely from the underside thereof in substantial alignment with the underside of said back-support section; and a curved brace having at least one movable wheel projecting from the top end thereof and of a predetermined length and rounded shape, fixedly connected at the bottom thereof at a predetermined angle, at an axis formed at a predetermined point on said anchor tab, to a drive bar, said drive bar being pivotally connected to said rider ring.

* * * * *